US010022836B2

(12) United States Patent
Feng et al.

(10) Patent No.: US 10,022,836 B2
(45) Date of Patent: Jul. 17, 2018

(54) POLISHING PAD, POLISHING APPARATUS AND METHOD FOR MANUFACTURING POLISHING PAD

(71) Applicant: San Fang Chemical Industry Co., Ltd., Kaohsiung (TW)

(72) Inventors: Chung-Chih Feng, Kaohsiung (TW); I-Peng Yao, Kaohsiung (TW); Yung-Chang Hung, Kaohsiung (TW); Wei-Te Liu, Kaohsiung (TW); Chun-Ta Wang, Kaohsiung (TW)

(73) Assignee: San Fang Chemical Industry Co., Ltd., Kaohsiung (TW)

( * ) Notice: Subject to any disclaimer, the term of this patent is extended or adjusted under 35 U.S.C. 154(b) by 0 days.

(21) Appl. No.: 14/848,147

(22) Filed: Sep. 8, 2015

(65) Prior Publication Data

US 2016/0082568 A1 Mar. 24, 2016

(30) Foreign Application Priority Data

Sep. 19, 2014 (TW) ..... 103132347 A

(51) Int. Cl.

| | |
|---|---|
| ***B24B 37/24*** | (2012.01) |
| ***B24D 18/00*** | (2006.01) |
| ***B24D 3/28*** | (2006.01) |

(52) U.S. Cl.

CPC ..... *B24B 37/24* (2013.01); *B24D 3/28* (2013.01); *B24D 18/0027* (2013.01)

(58) Field of Classification Search

CPC ..... B24B 37/24; B24D 18/0027; B24D 3/28

See application file for complete search history.

(56) References Cited

U.S. PATENT DOCUMENTS

| | | | | |
|---|---|---|---|---|
| 2,703,128 A * | 3/1955 | Darrow | B60C 9/09 | 152/557 |
| 4,093,763 A * | 6/1978 | Hartmann | D04H 3/009 | 427/377 |
| 4,728,552 A * | 3/1988 | Jensen, Jr. | B24B 37/24 | 101/376 |
| 4,735,849 A * | 4/1988 | Murakami | D04H 3/10 | 28/104 |
| 4,841,684 A * | 6/1989 | Hall, Jr. | B24D 11/00 | 156/148 |
| 6,479,413 B1 * | 11/2002 | Booher | F16D 69/026 | 442/101 |

(Continued)

FOREIGN PATENT DOCUMENTS

| | | |
|---|---|---|
| TW | I370758 | 8/2012 |
| TW | 201404531 | 2/2014 |
| TW | I513546 | 12/2015 |

OTHER PUBLICATIONS

Office action and search report dated May 25, 2016 for the corresponding Taiwan Patent Application No. 103132347.

English translation of the search report dated May 25, 2016 for the corresponding Taiwan Patent Application No. 103132347.

US 20150174725 corresponds toTW 201404531 and TW I513546.

Office action dated Mar. 20, 2017 for the corresponding China Patent Application No. 201410733404.1.

(Continued)

*Primary Examiner* — Marc Carlson

(74) *Attorney, Agent, or Firm* — WPAT, P.C., Intellectual Property Attorneys; Anthony King

(57) ABSTRACT

The present invention relates to a polishing pad comprising a base sheet containing a restriction layer. The invention also relates to a polishing apparatus and a method for manufacturing a polishing pad.

8 Claims, 6 Drawing Sheets

(56) References Cited

U.S. PATENT DOCUMENTS

| | | | | |
|---|---|---|---|---|
| 2005/0020171 | A1* | 1/2005 | Yoshida | B01D 39/163 442/327 |
| 2008/0171493 | A1* | 7/2008 | Feng | B24B 37/20 451/59 |
| 2008/0287047 | A1* | 11/2008 | Feng | B24B 37/24 451/532 |
| 2010/0146863 | A1* | 6/2010 | Feng | B24B 37/22 51/296 |
| 2011/0045744 | A1* | 2/2011 | Feng | B24B 37/22 451/41 |
| 2013/0331014 | A1* | 12/2013 | Shiro | B24B 37/24 451/532 |
| 2015/0174725 | A1* | 6/2015 | Kimura | B24B 37/22 451/41 |

OTHER PUBLICATIONS

Search report dated Mar. 20, 2017 for the corresponding China Patent Application No. 201410733404.1.

English translation of the search report dated Mar. 20, 2017 for the corresponding China Patent Application No. 201410733404.1.

Office action dated Dec. 12, 2017 for the corresponding Taiwan Patent Application No. 103132347.

Search report dated Dec. 12, 2017 for the corresponding Taiwan Patent Application No. 103132347.

English translation of the search report dated Dec. 12, 2017 for the corresponding Taiwan Patent Application No. 103132347.

* cited by examiner

POLISHING PAD, POLISHING APPARATUS AND METHOD FOR MANUFACTURING POLISHING PAD

BACKGROUND OF THE INVENTION

1. Field of the Invention

The present invention relates to a polishing pad, a polishing apparatus and a method for manufacturing a polishing pad.

2. Description of the Related Art

Polishing generally refers to a wear control for a preliminary coarse surface in a process of chemical mechanical polishing (CMP), which makes the slurry containing fine particles evenly dispersed on the upper surface of a polishing pad, and at the same time places a substrate to be polished against the polishing pad and then rubs the substrate to be polished repeatedly with a regular motion. The substrate to be polished may be objects such as a semiconductor, a storage medium substrate, an integrated circuit, an LCD flat-panel glass, an optical glass and a photoelectric panel. During the polishing process, a polishing pad must be used for polishing the substrate to be polished, and the quality of the polishing pad directly influences the polishing effect of the substrate to be polished.

FIG. 1 shows a schematic view of a polishing apparatus with a conventional polishing pad. The polishing apparatus 1 includes a lower base plate 11, a mounting 12, a substrate to be polished 13, an upper base plate 14, a polishing pad 15 and slurry 16. The lower base plate 11 is positioned opposite to the upper base plate 14. The mounting 12 is adhered to the lower base plate 11 through an adhesive layer (not shown) and is used for carrying and mounting the substrate to be polished 13. The polishing pad 15 is mounted on the upper base plate 14, and faces to the lower base plate 11 for polishing the substrate to be polished 13.

The operation mode of the polishing apparatus 1 is as follows. First, the substrate to be polished 13 is mounted on the mounting 12, and then both the upper and lower base plates 14 and 11 are rotated and the lower base plate 11 is simultaneously moved downward, such that the polishing pad 15 contacts the surface of the substrate to be polished 13, and a polishing operation for the substrate to be polished 13 may be performed by continuously supplementing the slurry 16 and using the effect of the polishing pad 15.

When polishing, the polishing pad 15 simultaneously withstands the pressure of the lower base plate 11 and upper base plate 14 from different ways. In order to avoid scraping the substrate to be polished 13, the polishing pad 15 usually comprises a polishing sheet and a base sheet. Depending on the substrate to be polished 13, the material of the polishing pad may be a non-woven fabric, an elastomer, or a mixture thereof. Most of the materials of the base sheet are a non-woven fabric as a main body and an elastomer filled therein. When the base sheet contains the non-woven fabric, it has better compression rate and recovery rate than that of the polishing sheet. Wherein, the compression rate can increase the adaptation between the polishing sheet and the substrate to be polished, and the recovery rate can increase the life span of the polishing pad.

However, in the manufacture of the non-woven fabric, control of the thickness uniformity is not easy, so using the base sheet with the non-woven fabric may often cause many problems due to the non-uniform thickness. For example, when the polishing pad withstands the pressure, the non-uniform thickness of the non-woven fabric causes the diversity of the density in different areas of the base sheet and yields the diversity of the compression rate. The area where the compression rate is smaller or the thickness is thicker may lead the friction between the polishing pad and the substrate to be polished to become bigger, and the polishing pad also wears faster. Due to the difference of the wear degree, a surface of the polishing pad becomes more uneven that causes unstable polishing surface removal rate of the substrate to be polished and poor flatness, and forms a defective product finally.

Therefore, a novel polishing pad in the field is needed to be developed to overcome the defect of the aforementioned non-uniform pressure of the non-woven fabric in the base sheet and to improve the polishing effect.

SUMMARY OF THE INVENTION

The present invention is to add a restriction layer in a base sheet of a polishing pad to obtain the base sheet with uniform thickness and attached amount. Because the structure of the restriction layer is compact and stable, and the restriction layer has uniform weight and thickness, it can yield uniform compression to avoid deformation when polishing. Therefore, the friction between the polishing pad and a substrate to be polished is also uniform, and it can increase the flatness of a surface of the substrate to be polished, and it can prevent the indentation and deformation of the polishing pad.

The invention provides a polishing pad comprising a polishing sheet and a base sheet, wherein the base sheet comprises:

- a restriction layer comprising a plurality of first oriented fibers and a plurality of second oriented fibers, wherein all the first oriented fibers are arranged toward a first direction; all the second oriented fibers are arranged toward a second direction; and the first direction intersects with the second direction to define a space; and
- a first polymeric elastomer filling in the space defined by the first direction and the second direction.

The invention also provides a polishing apparatus comprising:

- a base plate;
- a substrate to be polished;
- the polishing pad mentioned above, which is adhered on the base plate for polishing the substrate to be polished; and
- a polishing slurry, which is contacting with the substrate to be polished for polishing.

The invention further provides a method for manufacturing the aforementioned polishing pad, wherein the base sheet is provided by a process comprising:

(a) providing a restriction layer comprising a plurality of first oriented fibers and a plurality of second oriented fibers, wherein all the first oriented fibers are arranged toward a first direction; all the second oriented fibers are arranged toward a second direction; and the first direction intersects with the second direction to define a space; and (b) impregnating the restriction layer into a solution comprising a first polymeric elastomer to make the first polymeric elastomer to fill in the space defined by the first direction and the second direction.

DETAILED DESCRIPTION OF THE INVENTION

Figure 1:
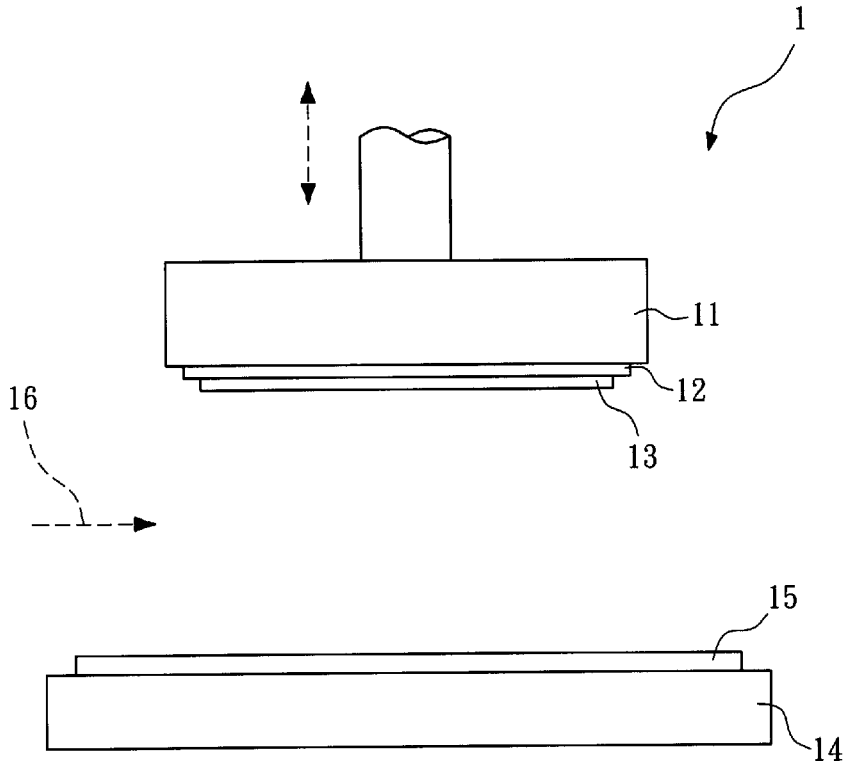
FIG 1 (Prior Art)
FIG. 1 shows a schematic view of a polishing apparatus with a conventional polishing pad.

The invention provides a polishing pad comprising a polishing sheet and a base sheet, wherein the base sheet comprises:

a restriction layer comprising a plurality of first oriented fibers and a plurality of second oriented fibers, wherein all the first oriented fibers are arranged toward a first direction; all the second oriented fibers are arranged toward a second direction; and the first direction intersects with the second direction to define a space; and a first polymeric elastomer filling in the space defined by the first direction and the second direction.

The term "a polishing pad" as used herein refers to a pad for planarizing a substrate to be polished in a process of chemical mechanical polishing, which is used against a substrate to be polished; wherein the polishing pad repeats the action regularly to polish the substrate to be polished and coordinates with the slurry having fine particles for wearing the coarse surface of the substrate to be polished until smooth.

The polishing sheet according to the invention is a portion in the polishing pad which is used to wear the substrate to be polished. Depending on the substrate to be polished, the material of the polishing sheet may be a non-woven fabric, an elastomer, or a mixture thereof.

The term "a non-woven fabric" as used herein refers to a manufactured sheet, web or mat of directionally or randomly orientated fibers, bonded by friction, and/or cohesion and/or adhesion, excluding paper and products which are woven, knitted, tufted, stitch-bonded incorporating binding yarns or filaments, or felted by wet-milling, whether or not additionally needled. The fibers may be of natural or man-made origin. They may be staple or continuous filaments or be formed in situ. Depending on the method of forming the web, the nonwoven fabric usually comprises a composite nonwoven fabric, a needle-punched nonwoven fabric, a melt-blown nonwoven fabric, a spun bonded nonwoven fabric, a dry-laid nonwoven fabric, a wet-laid nonwoven fabric, a stitch-bonded nonwoven fabric, or a spun lace nonwoven fabric. Compared with a woven fabric, the non-woven fabric has a better material property.

As used herein, the term "a polymeric elastomer" refers to a type of polymer that exhibits rubber-like qualities. When polishing, the polymeric elastomer serves as a good buffer to avoid scraping a surface of the substrate to be polished. Preferably, the polymeric elastomer comprises a foaming resin. As used herein, the term "a foaming resin" refers to a material containing a thermoplastic resin and a thermodecomposing foaming agent. Preferably, the resin comprises at least one selected from the group consisting of polyurethane, polyolefin, polycarbonate, polyvinyl alcohol, nylon, elastic rubber, polystyrene, poly aromatic molecules, fluorine-containing polymer, polyimide, cross-linked polyurethane, cross-linked polyolefin, polyether, polyester, polyacrylate, elastic polyethylene, polytetrafluoroethene, poly (ethylene terephthalate), poly aromatic amide, polyarylalkene, polymethyl methacrylate, a copolymer thereof, a block copolymer thereof, a mixture thereof, and a blend thereof.

A manner of foaming the foaming resin according the invention may be chemically foaming or physically foaming; wherein the chemically foaming manner uses an agent that can carry out a chemical reaction to yield gas, and the gas after reaction is evenly distributed in the resin composition. On the other hand, the physically foaming manner comprises infiltrating gas into the resin composition, and the gas is evenly distributed in the resin composition by stirring.

In one preferred embodiment of the invention, the polishing sheet further comprises pores. In one embodiment of the invention, the pores are pores between the non-woven fabric fibers. In one another embodiment of the invention, the pores are formed by the polymeric elastomer. In one another embodiment of the invention, the pores are formed by the polymeric elastomer and fibers. The pores may be continuous pores or independent pores. The term "continuous pores" as used herein refers to pores where at least two pores connecting to each other to form pores similar to ant nests. Preferably, the pores are continuous pores, which benefit the flow of slurry and distribution of polishing particles and removal of polishing residues. In one preferred embodiment of the invention, the continuous pores have a pore size ranging from about 0.1 μm to about 500 μm. In another aspect, preferably, the polishing sheet comprises a surface and the surface comprises pores.

In one preferred embodiment of the invention, the pores of the surface of the polishing sheet are formed by removing a certain thickness of the surface of the formed polishing sheet by polishing or scraping for exposing the pores of the surface.

In one preferred embodiment of the invention, the polishing sheet further comprises a plurality of polishing particles. The polishing particles are evenly distributed in the polishing sheet. The particles can exist in a frame formed by the non-woven fabric or the polymeric elastomer, and they can also exist in the pores. Preferably, the polishing particles comprise cerium dioxide, silicon dioxide, aluminum oxide, yttrium oxide, or ferric oxide. Additionally, the particle diameter of the polishing particles is from about 0.01 μm to about 10 μm.

In one preferred embodiment of the invention, the polishing sheet is formed by taking the base sheet as a carrier, and coating the polymeric elastomer on the base sheet; after curing, washing and drying, the polishing sheet is formed. The steps of curing, washing and drying may be in the same manners of the following methods of curing, washing and drying the first polymeric elastomer.

In one another preferred embodiment of the invention, the polishing sheet may be formed first, and then the polishing sheet is adhered with the base sheet. The manner of adhesion may be a conventional one.

The term "a base sheet" as used herein refers to a film between the polishing sheet and a polishing machine. When the polishing pad simultaneously withstands the pressure of a lower base plate and an upper base plate from different ways in polishing, the base sheet avoids scraping a substrate to be polished.

Artisans skilled in this field may choose suitable kinds of fibers according to the disclosure of the specification. As used herein, the term "fibers" refers to single fibers or composite fibers; preferably composite fibers. Preferably, the fibers are made of at least one material selected from the group consisting of polyamide, terephthalamide, polyester, polymethyl methacrylate, polyethylene terephthalate, polyacrylonitrile, and a mixture thereof.

Figure 2:
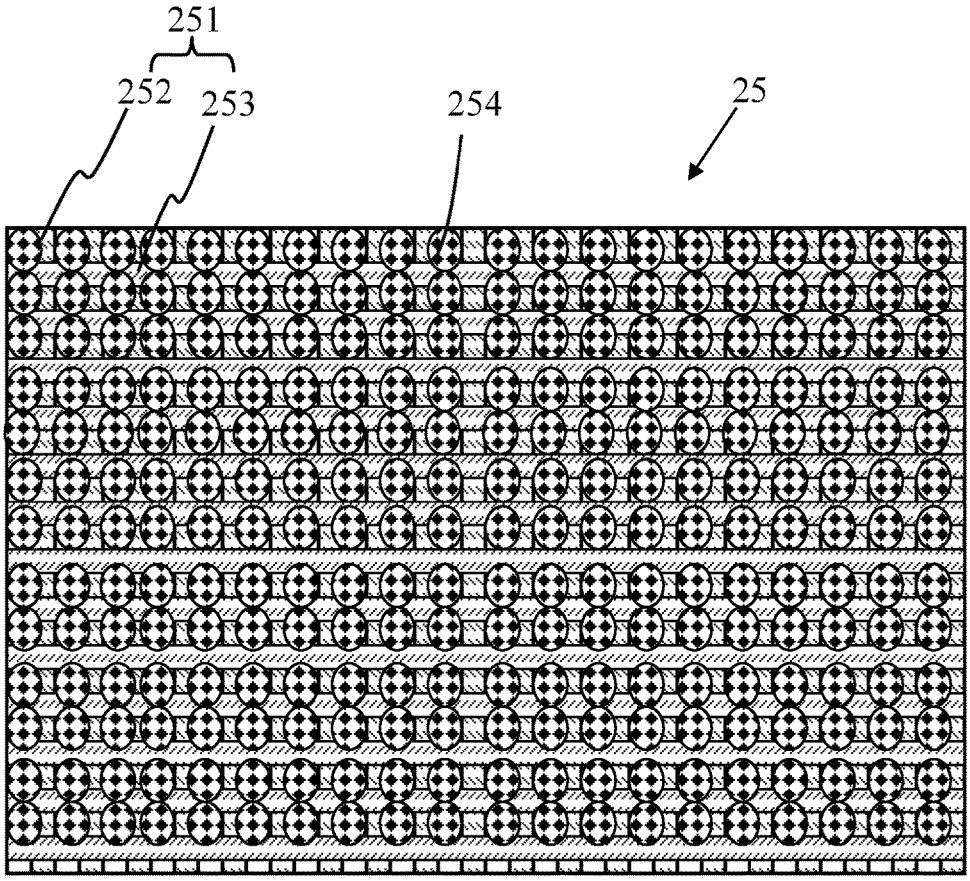
FIG. 2 shows a top view of a base sheet according to one embodiment of the invention.

Referring to FIG. 2, a base sheet 25 according to the invention comprises a restriction layer 251, wherein the restriction layer 251 comprises a plurality of first oriented fibers 252 and a plurality of second oriented fibers 253. In an embodiment, the restriction layer 251 consists of the plurality of first oriented fibers 252 and the plurality of second oriented fibers 253. All the first oriented fibers 252 are arranged toward a first direction; all the second oriented fibers 253 are arranged toward a second direction; and the first direction intersects with the second direction. In an embodiment, all the first oriented fibers 252 are arranged entirely in a first direction; all the second oriented fibers 253 are arranged entirely in a second direction. The first direction and the second direction are substantially parallel to an upper surface of the restriction layer 251. By providing the oriented fibers, it can further uniformly disperse the pressure from the polishing sheet to a main body of the base sheet, and provide buffering capacity for the polishing pad. Besides, by providing the oriented fibers, it can provide a frame in an interior region of the base sheet to benefit uniform thickness and attached amount of the whole base sheet. Therefore, the friction between the polishing pad and the substrate to be polished is more uniform which can increase the surface flatness of the substrate to be polished to prevent the indentation and deformation of the polishing pad.

The thickness of the restriction layer according to the invention may be chosen as needed; preferable, the thickness is from about 0.05 mm to about 2.0 mm. If the thickness is less than about 0.05 mm, the pressure dispersion effect is not good; if the thickness is more than about 2.0 mm, the buffer effect is not good.

The base sheet 25 according to the invention comprises a first polymeric elastomer 254, and the restriction layer 251 is embedded in the first polymeric elastomer 254. Preferable, the polymeric elastomer 254 simultaneously covers the first oriented fibers 251 and/or the second oriented fibers 252 partially or fully. In another aspect, the restriction layer 251 may be partially or fully embedded in the first polymeric elastomer 254.

Figure 3:
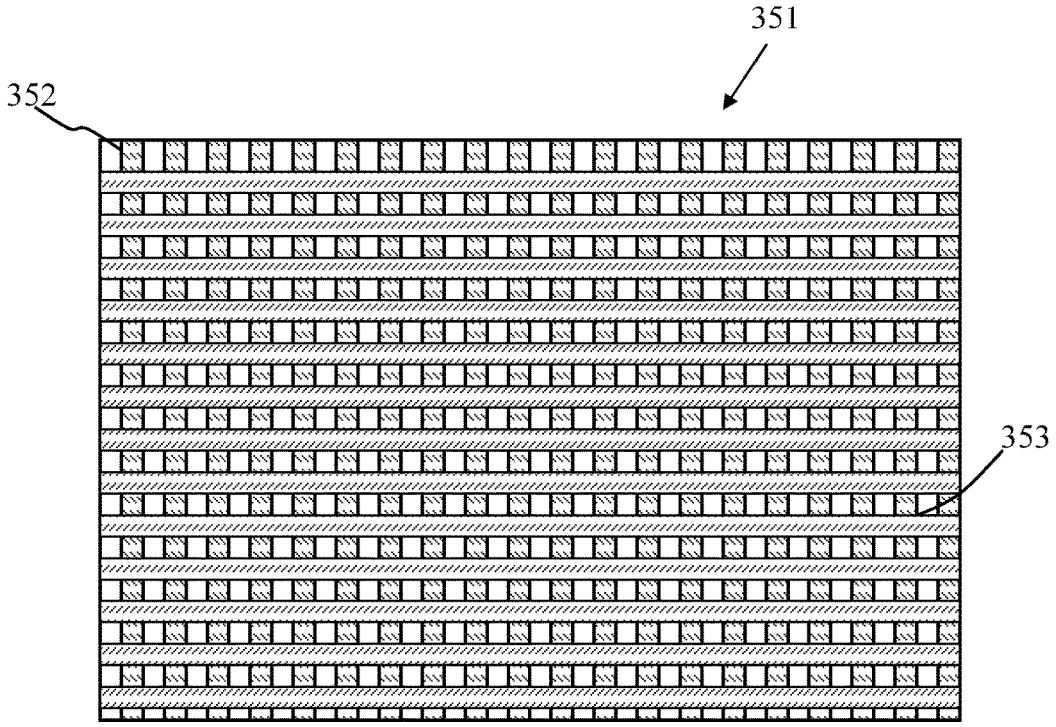
FIG. 3 shows a top view of a restriction layer according to one embodiment of the invention.

The angle between the first direction and the second direction according to the invention may be any angle. FIG. 3 shows a top view of a restriction layer 351 in one embodiment according to the invention. The restriction layer 351 comprises a plurality of first oriented fibers 352 and a plurality of second oriented fibers 353. All the first oriented fibers 352 are arranged toward a first direction, and all the second oriented fibers 353 are arranged toward a second direction. The first direction is perpendicular to the second direction. In one embodiment, the restriction layer 351 consists of a plurality of first oriented fibers 352 and a plurality of second oriented fibers 353. All the first oriented fibers 352 are arranged entirely in a first direction, and all the second oriented fibers 353 are arranged entirely in a second direction. The first direction is perpendicular to the second direction. The first direction and the second direction are substantially parallel to an upper surface of the restriction layer 351.

The first oriented fibers and the second oriented fibers according to the invention may be stacked or intersected with each other to form the restriction layer. Preferably, the first oriented fibers and the second oriented fibers are located on the same layer structure and woven with each other. In one preferred embodiment according to the invention, the restriction layer is provided by a woven fabric.

Figure 4:
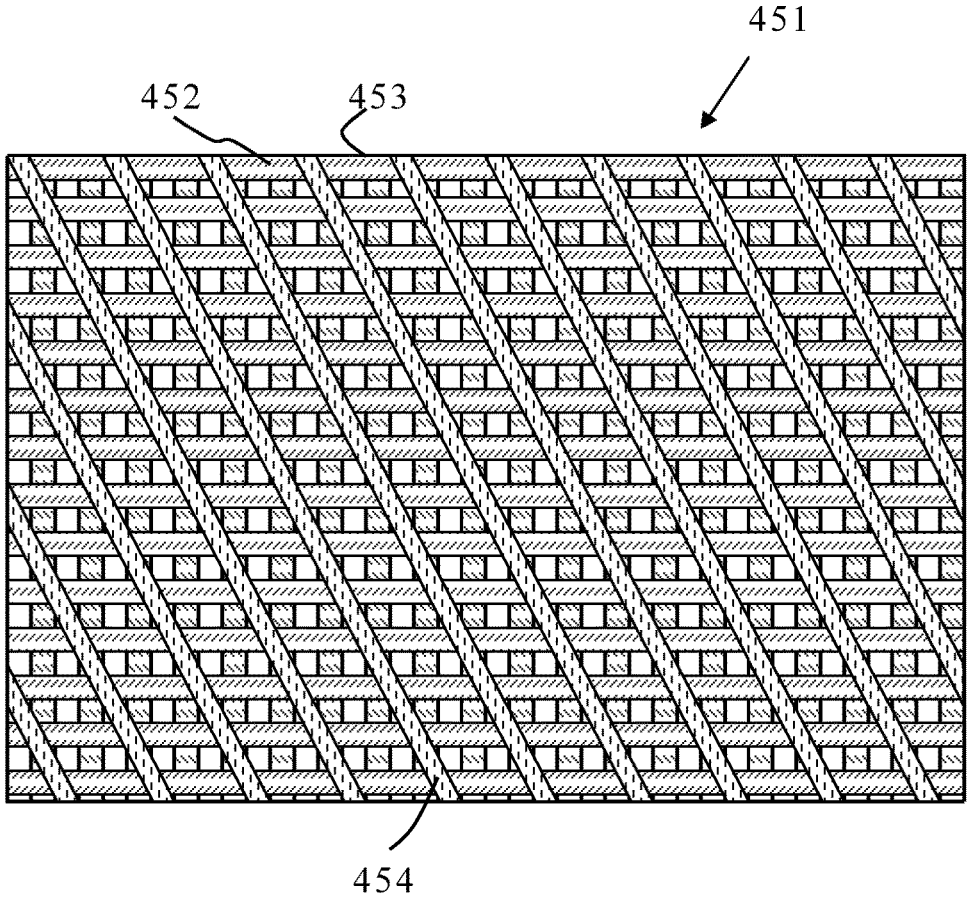
FIG. 4 shows a top view of a restriction layer according to another embodiment of the invention.

FIG. 4 shows a top view of a restriction layer in one embodiment according to the invention. The restriction layer 451 comprises a plurality of first oriented fibers 452, a plurality of second oriented fibers 453 and further a plurality of third oriented fibers 454. All the third oriented fibers 454 are arranged toward a third direction and the third oriented fibers 454 intersect with the first oriented fibers 452 and/or the second oriented fibers 453. In the embodiment, besides the first oriented fibers 452 and the second oriented fibers 453, the restriction layer 451 may comprise other oriented fibers, such as the third oriented fibers 454. In one embodiment, the restriction layer 451 consists of a plurality of first oriented fibers 452, a plurality of second oriented fibers 453 and further a plurality of third oriented fibers 454. All the third oriented fibers 454 are arranged entirely a third direction and the third oriented fibers 454 intersect with the first oriented fibers 452 and the second oriented fibers 453. The third direction is substantially parallel to an upper surface of the restriction layer 451.

Preferably, the oriented fibers according to the invention are long-fiber, which can increase the effect of pressure distribution. More preferably, as shown in FIG. 3 or FIG. 4, each of the first oriented fibers 352, 452 and/or each of the second oriented fibers 353, 453 run through the base sheet.

The material of the oriented fibers may be the same or different. Preferably, the material of the first oriented fibers is the same with that of the second oriented fibers. In one embodiment according to the invention, the materials of the oriented fibers have high tenacity and not easy to break off.

Preferably, the base sheet is provided by roll-to-roll, which can improve batch uniformity.

Figure 5:
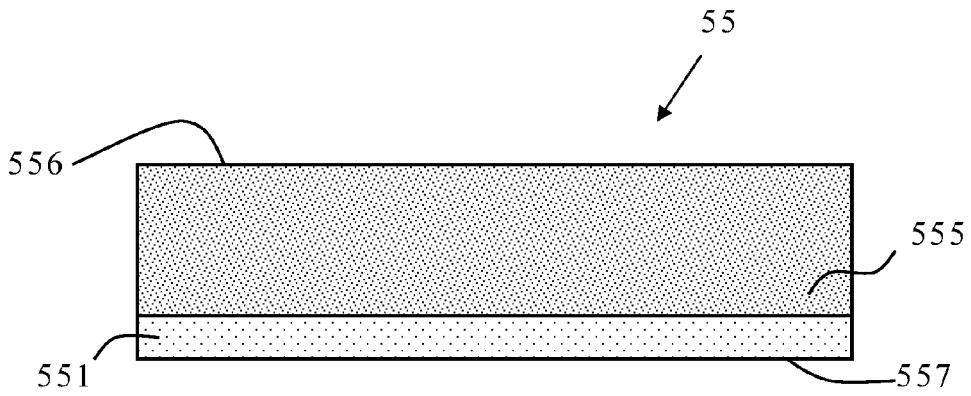
FIG. 5 shows a sectional view of a base sheet according to one embodiment of the invention.

FIG. 5 shows a sectional view of a base sheet 55 in one embodiment according to the invention. The base sheet 55 comprises a restriction layer 551 and a second polymeric elastomer 555. The second polymeric elastomer 555 constitutes one surface 556 of the base sheet 55, and the restriction layer 551 constitutes the other surface 557 of the base sheet 55. In the embodiment, the restriction layer 551 and the second polymeric elastomer 555 are a two-layered structure; wherein the second polymeric elastomer 555 is further formed by being coated on the restriction layer 551 filled with the first polymeric elastomer (not shown).

Figure 6:
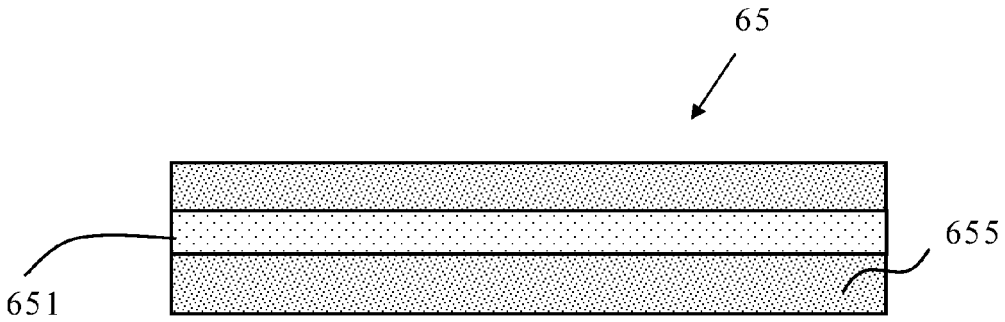
FIG. 6 shows a sectional view of a base sheet according to another embodiment of the invention.

FIG. 6 shows a sectional view of a base sheet 65 in one embodiment according to the invention. The base sheet 65 comprises a restriction layer 651 and a second polymeric elastomer 655. The restriction layer 651 is sandwiched into the second polymeric elastomer 655. In the embodiment, the restriction layer 551 and the second polymeric elastomer 555 are provided by a two-layered structure, wherein the second polymeric elastomer 655 is further formed by being coated on the restriction layer 651 filled with the first polymeric elastomer (not shown)

The materials of first polymeric elastomer and the second polymeric elastomer according to the invention may be the same or different; preferably, the materials of the first polymeric elastomer and the second polymeric elastomer are the same.

The polishing pad according to the invention comprising the base sheet having the restriction layer provides the base sheet with uniform thickness and attached amount. Because the structure of the restriction layer is compact and stable, and the weight and thickness of the restriction layer is uniform, it can yield a uniform compression to avoid deformation when polishing. Therefore, the friction between the polishing pad and a substrate to be polished is also uniform, and it can increase the flatness of a surface of the substrate to be polished, and it can prevent the indentation and deformation of the polishing pad.

The invention also provides a polishing apparatus, wherein the polishing apparatus comprising:

a base plate;

a substrate to be polished;

the polishing pad according to claim 1, which is adhered on the base plate for polishing the substrate to be polished; and a polishing slurry, which is contacting with the substrate to be polished for polishing.

Preferably, the polishing apparatus further comprising:

a lower base plate which is positioned opposite to the base plate; and a mounting sheet which is adhered to the lower base plate for carrying and mounting the substrate to be polished.

Figure 7:
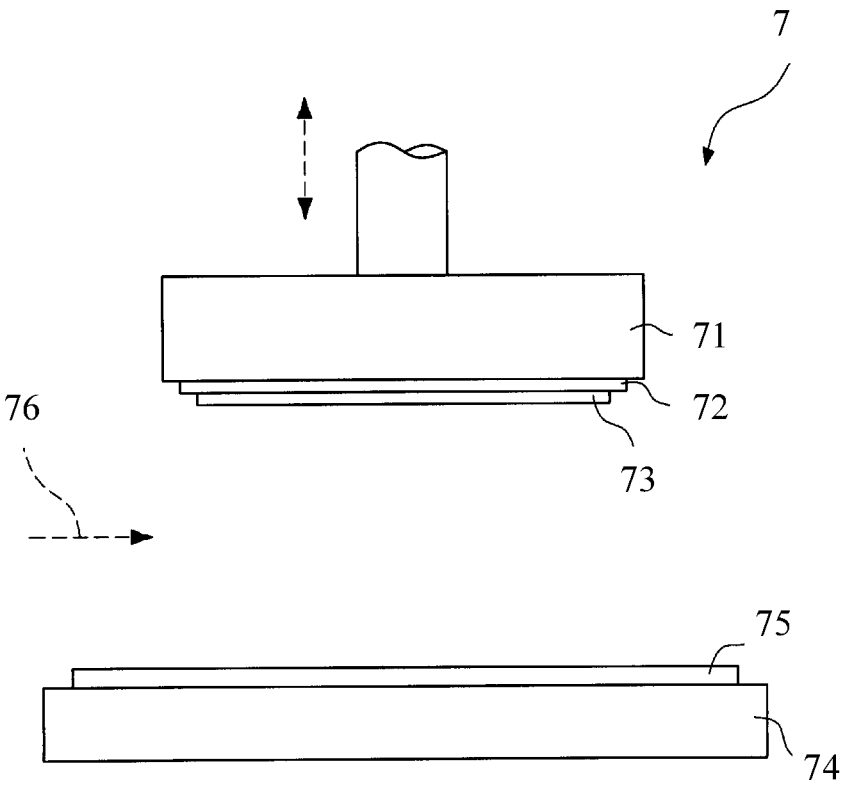
FIG. 7 shows a schematic view of a polishing apparatus with a polishing pad according to the present invention.

FIG. 7 shows a schematic view of a polishing apparatus according to the polishing pad of the invention. The polishing apparatus 7 includes a lower base plate 71, a mounting sheet 72, a substrate to be polished 73, an upper base plate 74, a polishing pad 75 and slurry 76. The lower base plate 71 is positioned opposite to the upper base plate 74. The mounting sheet 72 is adhered to the lower base plate 71 through an adhesive layer (not shown) and is used for carrying and mounting the substrate to be polished 73. The polishing pad 75 is mounted on the upper base plate 74, and faces to the lower base plate 71 for polishing the substrate to be polished 73.

The operation mode of the polishing apparatus 7 is as follows. First, the substrate to be polished 73 is mounted on the mounting sheet 72, and then both the upper and lower base plates 74 and 71 are rotated and the lower base plate 71 is simultaneously moved downward, such that the polishing pad 75 contacts the surface of the substrate to be polished 73, and the substrate to be polished 73 may be performed by continuously supplementing the slurry 76 and using the effect of the polishing pad 75.

The invention further provides a method for manufacturing the aforementioned polishing pad, wherein the base sheet is provided by a process comprising:

(a) providing a restriction layer comprising a plurality of first oriented fibers and a plurality of second oriented fibers, wherein all the first oriented fibers are arranged toward a first direction; all the second oriented fibers are arranged toward a second direction; and the first direction intersects with the second direction to define a space; and (b) impregnating the restriction layer into a solution comprising a first polymeric elastomer to make the first polymeric elastomer to fill in the space defined by the first direction and the second direction.

The step (a) according to the invention is stacking or weaving the first oriented fibers and the second oriented fibers to form the restriction layer. Preferably, the first oriented fibers and the second oriented fibers are woven with each other. In one embodiment according to the invention, the step (a) comprises stacking, weaving or needle punching the first oriented fibers with the second oriented fibers and making the first oriented fibers to intersect with the second oriented fibers to provide the restriction layer.

The manner of impregnating the restriction layer into the solution comprising the first polymeric elastomer in the step (b) according to the invention is a common manner of impregnating fibers in an elastomer solution. The impregnating condition may be chosen by artisans skilled in this field. A suitable solvent used in the solution comprising the first polymeric elastomer comprises dimethylformamide (DMF). The solution comprising the first polymeric elastomer optinally comprises an additive such as a surfactant. The elastomer concentration in the solution comprising the first polymeric elastomer is preferably from about 2 wt % to about 60 wt %.

Preferably, the step (b) comprises impregnating the whole restriction layer into the solution comprising the first polymeric elastomer.

In one preferred embodiment according to the invention, the method for manufacturing the polishing pad further comprises a step (c) of curing the first polymeric elastomer impregnated into the restriction layer. In one embodiment according to the invention, the restriction layer is placed into a curing solution to cure. Preferably, the curing solution comprises 0 to about 40 wt % dimethylformamide in water. The curing condition may be chosen by artisans skilled in this field. Preferably, curing is carried out at room temperature and pressure. Since the restriction layer is impregnated into the solution comprising the first polymeric elastomer in the step (b), the restriction layer is embedded in the first polymeric elastomer after curing in step (c).

In one preferred embodiment according to the invention, the method for manufacturing the polishing pad further comprises a step (c1) of washing the restriction layer after the step (c). The purpose of washing is to remove residues from the restriction layer. In one embodiment according to the invention, the washing step is carried out with water and an extrusion roller is optionally used. The washing condition may be chosen by artisans skilled in this field. Preferably, the base sheet is washed at about 50° C. to about 90° C. and then extruded many times by the extrusion roller.

In one more preferred embodiment according to the invention, the method for manufacturing the polishing pad further comprises a step (c2) of drying the restriction layer after the step (c1). The purpose of drying is to remove excess solvent from the step (c1). The drying condition may be chosen by artisans skilled in this field. In one embodiment according to the invention, the drying is air drying and the drying temperature is about 100° C. to about 160° C.

Preferably, the method for manufacturing the polishing pad further comprises a step (c3) of mechanically polishing the surface of the restriction layer and the first polymeric elastomer. For example, the mechanically polishing may be conducted by sand blasting. The mechanically polishing condition may be chosen by artisans skilled in this field.

In one preferred embodiment according to the invention, the step (b) and (c) are repeated many times. The kinds of the first polymeric elastomer may be the same or different in every time uses.

While embodiments of the present invention have been illustrated and described, various modifications and improvements can be made by persons skilled in the art. The embodiments of the present invention are therefore described in an illustrative but not restrictive sense. It is intended that the present invention is not limited to the particular forms as illustrated, and that all the modifications not departing from the spirit and scope of the present invention are within the scope as defined in the appended claims.

What is claimed is:

1. A polishing pad comprising a polishing sheet and a base sheet, wherein the base sheet comprises:

a restriction layer consisting of a plurality of first oriented fibers, a plurality of second oriented fibers and a plurality of third oriented fibers, wherein all the first oriented fibers are arranged entirely in a first direction;

all the second oriented fibers are arranged entirely in a second direction; all the third oriented fibers are arranged entirely in a third direction; the first direction, the second direction and the third direction are substantially parallel to an upper surface of the restriction layer; the first oriented fibers and the second oriented fibers are located on a same layer structure and woven with each other; the first direction intersects with the second direction; and the third oriented fibers intersect with the first oriented fibers and the second oriented fibers; and a first polymeric elastomer, wherein the restriction layer is embedded in the first polymeric elastomer.

2. The polishing pad according to claim 1, wherein the polishing sheet comprises a surface and the surface comprises a plurality of holes.

3. The polishing pad according to claim 1, wherein the first direction is perpendicular to the second direction.

4. The polishing pad according to claim 1, wherein each of the first oriented fibers and/or each of the second oriented fibers runs through the base sheet.

5. The polishing pad according to claim 1, wherein the base sheet further comprises a second polymeric elastomer, wherein the second polymeric elastomer constitutes one surface of the base sheet, and the restriction layer constitutes the other surface of the base sheet.

6. The polishing pad according to claim 1, wherein the base sheet further comprises a second polymeric elastomer and the restriction layer is sandwiched into the second polymeric elastomer.

7. A method for manufacturing a polishing pad comprising a polishing sheet and a base sheet, wherein the base sheet comprises:

a restriction layer consisting of a plurality of first oriented fibers, a plurality of second oriented fibers and a plurality of third oriented fibers, wherein all the first oriented fibers are arranged entirely in a first direction; all the second oriented fibers are arranged entirely in a second direction; all the third oriented fibers are arranged entirely in a third direction; the first direction, the second direction and the third direction are substantially parallel to an upper surface of the restriction layer; the first oriented fibers and the second oriented fibers are located on a same layer structure and woven with each other; the first direction intersects with the second direction; and the third oriented fibers intersect with the first oriented fibers and the second oriented fibers; and a first polymeric elastomer, wherein the restriction layer is embedded in the first polymeric elastomer, wherein the base sheet is provided by a process comprising:

(a) providing a restriction layer consisting of a plurality of first oriented fibers, a plurality of second oriented fibers and a plurality of third oriented fibers, wherein all the first oriented fibers are arranged entirely in a first direction; all the second oriented fibers are arranged entirely in a second direction; all the third oriented fibers are arranged entirely in a third direction; the first direction, the second direction and the third direction are substantially parallel to an upper surface of the restriction layer; the first oriented fibers and the second oriented fibers are located on a same layer structure and woven with each other; the first direction intersects with the second direction; and the third oriented fibers intersect with the first oriented fibers and the second oriented fibers; and (b) impregnating the restriction layer into a solution comprising a first polymeric elastomer to make the restriction layer embedded in the first polymeric elastomer.

8. The method according to claim 7, wherein the step (a) comprises weaving the first oriented fibers with the second oriented fibers and making the first oriented fibers to intersect with the second oriented fibers to provide the restriction layer.

* * * * *